United States Patent [19]

Hashimoto et al.

[11] Patent Number: 4,801,247

[45] Date of Patent: Jan. 31, 1989

[54] VARIABLE DISPLACEMENT PISTON PUMP

[75] Inventors: Toshio Hashimoto; Susumu Yoshino; Akira Ohashi, all of Kanagawa; Masao Egi, Tokyo; Yasuyuki Shingu, Kanagawa; Takashi Yoshioka, Tokyo; Siro Hattori, Kanagawa, all of Japan

[73] Assignee: Yuken Kogyo Kabushiki Kaisha, Fujisawa, Japan

[21] Appl. No.: 900,445

[22] Filed: Aug. 26, 1986

[30] Foreign Application Priority Data

| | | | |
|---|---|---|---|
| Sep. 2, 1985 | [JP] | Japan | 60-193639 |
| Sep. 2, 1985 | [JP] | Japan | 60-193640 |
| Jan. 31, 1986 | [JP] | Japan | 61-19517 |
| Mar. 22, 1986 | [JP] | Japan | 61-61995 |
| Mar. 22, 1986 | [JP] | Japan | 61-61994 |
| Mar. 28, 1986 | [JP] | Japan | 61-68448 |

[51] Int. Cl.[4] ..... F04B 1/30

[52] U.S. Cl. ..... 417/213; 417/218

[58] Field of Search ..... 417/218–222; 92/12.1, 12.2; 91/506

[56] References Cited

U.S. PATENT DOCUMENTS

| | | | |
|---|---|---|---|
| 4,432,703 | 2/1984 | Beutler | 417/218 |
| 4,456,434 | 6/1984 | Ibiary | 417/218 |
| 4,507,057 | 3/1985 | Igarashi | 417/218 |
| 4,510,750 | 4/1985 | Izumi | 417/222 |
| 4,655,689 | 4/1987 | Westveer | 417/222 |
| 4,699,571 | 10/1987 | Bartholomaus | 417/218 |

FOREIGN PATENT DOCUMENTS

| | | | |
|---|---|---|---|
| 76876 | 4/1983 | European Pat. Off. | 417/307 |
| 164602 | 12/1985 | European Pat. Off. | 417/218 |
| 2206788 | 8/1973 | Fed. Rep. of Germany | 417/218 |
| 2723074 | 11/1978 | Fed. Rep. of Germany | 417/218 |
| 3016609 | 11/1981 | Fed. Rep. of Germany | 417/220 |

*Primary Examiner*—William L. Freeh

*Attorney, Agent, or Firm*—Fleit, Jacobson, Cohn & Price

[57] ABSTRACT

A variable displacement piston pump of the type in which the hydraulic pressure in a pressure chamber of an output flow variable element is controlled by a proportional electro-hydraulic control valve to control the displacement of the variable element against a spring to vary the output flow within a range between a maximum output flow and a full cut-off and the output pressure or both the output pressure and the output flow of the pump are controlled electro-hydraulically through a closed loop. The variable displacement piston pump includes flow detector for generating an electric signal corresponding to the output flow of the pump, pressure detector for generating an electric signal corresponding to the output flow of the pump, and control amplifier responsive to the difference between a flow setting signal and the output signal of the flow detector to control a driving control current supplied to the proportional electro-hydraulic control valve and also responsive to the detected output pressure reaching a predetermined value to control the driving control signal in accordance with the difference between a pressure setting signal and the output signal of the pressure detector.

26 Claims, 10 Drawing Sheets

VARIABLE DISPLACEMENT PISTON PUMP

BACKGROUND OF THE INVENTION

1. Field of the Invention

The present invention relates to variable displacement piston pumps and more particularly to a variable displacement piston pump of the type which electrically controls its output pressure or both of its output pressure and output flow by a proportional electro-hydraulic control valve.

2. Description of the Prior Art

With hydraulically-controlled variable displacement piston pumps known in the art, particularly in the case of the axial piston type, it has been the practice so that in order to control the tilt angle of a swash plate to vary the output flow, the output pressure is introduced into a pressure chamber of a control piston serving as a variable element in response to the operation of a pressure control valve adapted to open when the setting pressure is reached and in this way a full cut-off condition is obtained. In this case, in the full cut-off condition the control piston pressure chamber is communicated with the low pressure side by the opening of a bleed hole preliminarily formed in a control piston sliding sleeve in response to the movement of the control piston and therefore there are disadvantages that to ensure matching between the bleed hole and the control piston length is extremely difficult due to variations in the processing tolerance thus tending to cause a vibration phenomenon of the control piston and that despite much efforts made to eliminate this phenomenon, generally such vibration preventing measures decrease the sharpness of the full cut-off characteristic with the resulting increase in the so-called pressure drooping.

On the other hand, methods have been known in which proportional electro-hydraulic control valves are used to control the output flow and output pressure of a variable displacement piston pump. In the case of the ordinary conventional method, the output pressure is controlled by using a proportional electro-hydraulic relief valve so as to perform a hydraulic-pressure feedback control to attain a setting pressure corresponding to its input current and the control of the output flow is effected by controlling the displacement of the output flow variable element of the pump by a separate proportional electro-hydraulic control valve.

With the variable displacement piston pump of the above type, due to the use of the separately provided proportional electro-hydraulic control valves for the control of the pressure and flow, respectively, not only the control valves but also the associated components such as current amplifiers for driving the control valves must be provided separately with the resulting unavoidable increase in the size of the system and the power consumption. Moreover, the conventional variable displacement piston pump involves varies output flow varying factors causing variations in the speed of actuators such as a hydraulic motor and cylinders with the result that if a variation in the slip of the pump driving electric motor due to a change in the load changes its rotation speed, this speed change results in a variation of the pump output flow, that if the volumetric efficiency of the pump is varied due for example to an increase in the load pressure, this also results in a variation of the output flow, that if a temperature change of the hydraulic working fluid causes a change in its viscosity, this also results in a variation of the output flow and so on and these factors are particularly noted in cases where accurate control is required.

Control systems of the type employing the conventional variable displacement piston pump in combination with hydraulic compensator valves for close control purposes have been proposed and the conventional control system of this type has been designed so that its pressure control section and flow control section are operable independently of each other. Thus, pressure compensation for variations in the load flow during the pressure control and flow compensation for variations in the load pressure during the flow control must be provided by the separate hydraulic compensator valves and also the pressure and flow control systems are in the form of open loops thus making it impossible for the control system to compensate for the effects due to a hysteresis of the solenoid means of the control valve, the viscosity of the working fluid, etc.

SUMMARY OF THE INVENTION

With a view to overcoming the foregoing deficiencies in the prior art, it is a first object of the present invention to provide a variable displacement piston pump in which an electric control system is incorporated in a hydraulic control system of a variable element so that the electric control system can provide effective antivibration measures and moreover a sharp cut-off characteristic can be provided at the desired setting pressure established by an electric setting signal.

It is a second object of the invention to provide a variable displacement piston pump having a fail-safe function so that when the output pressure of the pump is increased abnormally, the pump is set in a cut-off condition irrespective of the electric control system.

It is a third object of the invention to provide a variable displacement piston pump in which both of the pressure and flow are controlled by a single proportional electro-hydraulic control valve thereby simplifying the hydraulic construction.

It is a fourth object of the invention to provide a variable displacement piston pump of a load-sensing control type in which both the pressure and flow are controlled by a single proportional electro-hydraulic control valve through a closed-loop control system including from an electric system to a hydraulic system thereby improving the characteristics through the elimination of hysteresis, the improvement of linearity, etc.

It is a fifth object of the invention to provide such variable displacement piston pump in which the pressure control and the flow control are mutually associated with each other in the closed loop control thereby smoothly effecting the switching between the flow control mode and the pressure control mode.

It is a sixth object of the invention to provide such variable displacement piston pump so designed that in an intermediate flow and pressure control range between a flow control range and a pressure control range, any instability of the pressure control due to variation in the flow rate is eliminated and the stable control is realized in the whole control range.

It is a seventh object of the invention to provide such variable displacement piston pump so designed that dynamic compensation is provided for various output flow varying factors within the closed loop thereby obtaining the characteristics required for accurate control and also the varying factors are monitored in level so as to preliminarily give an alarm for any fault in the component devices.

In accordance with one embodiment of the invention, a variable displacement piston pump varies its output flow by displacing a variable element through the control of hydraulic pressure and the pump includes a pressure sensor for generating an electric signal output corresponding to the pump output pressure, a proportional electro-hydraulic control valve for directing a part of an output hydraulic fluid to the variable element by way of a hydraulic fluid input passage with an opening which is proportional to an input current, and a control amplifier for receiving an externally applied pressure setting signal and the electric signal output from the pressure sensor to control the input current to the proportional electro-hydraulic control valve in such a manner that the variable element is set in a cut-off condition when the detected pressure by the pressure sensor reaches a setting pressure value.

In accordance with a modification of the embodiment, a safety valve is positioned in the hydraulic fluid input passage between the proportional electro-hydraulic control valve and the variable element so that when the pump output pressure reaches a predetermined upper limit value, the output pressure is directed to the variable element and the pump is set in the cut-off condition.

The output pressure of the operating pump is detected by the pressure sensor and it is then compared with the setting pressure by the control amplifier whereby when the detected value of the pressure sensor is equal to the setting pressure, the displacement of the variable element is automatically controlled and the full cut-off pressure of the pump is maintained. In this way, it is possible to effectively prevent as desired any vibration phenomenon of the variable element through the gain control of the control amplifier and there is no need to provide any antivibration measure in the hydraulic system thereby maintaining sharp the full cut-off characteristic. Thus, the pressure setting can be effected electrically from a remote place as desired with the resulting improvement of the operating quality and the output pressure is always detected electrically thus making it possible to provide a remote indication of the output pressure or use it for other control purposes.

In accordance with another embodiment of the invention, a variable displacement piston pump varies its output flow by displacing a variable element through the control of a hydraulic pressure opposing a spring force and the pump includes a displacement detector for detecting the displacement of the variable element, a pressure sensor for detecting the output pressure of the pump, a proportional electro-hydraulic three-way control valve for communicating the pressure chamber of the variable element with a tank port or a pump outlet port with an opening proportional to an input current, a first electric control circuit for adjusting the magnitude of the input current in accordance with the difference between an externally applied flow setting signal and a displacement detection signal from the displacement detector, and a second electric control circuit for receiving an externally applied pressure setting signal and the output pressure detection signal from the pressure sensor to control the input current value in such a manner that the variable element is set in a cut-off condition when the pressure detected by the pressure sensor reaches the setting pressure value.

In accordance with a modification of this embodiment, the proportional electro-hydraulic three-way control valve has a fail-safe function so that when there is no input current, the valve is restored to a functional state by the spring force to supply the output pressure to the variable element and thereby cut off the pump.

In accordance with another modification, the ordinary safety valve for directing the pump output pressure to the variable element and placing the pump in the cut-off condition when the output pressure reaches the predetermined upper limit value of the adjusted pressure is positioned in the hydraulic fluid passage between the proportional electro-hydraulic three-way control valve and the variable element.

In this case, a flow signal is derived from the displacement of the variable element of the pump so that the difference between the flow signal and a setting value is obtained and the output flow is feedback controlled through an electro-hydraulic closed loop and at the same time the output pressure detected by the pressure sensor is compared with a setting value thereby performing a cut-off control of the pressure through the electro-hydraulic closed loop. Thus, the single proportional electro-hydraulic three-way control valve provides the variable displacement piston pump of the load-sensing control type which includes the whole electric system and hydraulic system within the loop and is excellent in control quality. Also, there are effects that there is no need to provide any restrictor in the pump outlet line, that the whole pump is compact in construction, that the desired antivibration measure can be provided fairly freely through the gain control of the electric control system within the loop, that the adjustment at the place of use is simplified and that it is possible to improve the sharpness of the cut-off characteristic without increasing the pressure drooping due to the cut-off characteristic.

In accordance with another embodiment of the invention, a variable displacement piston pump includes a proportional electro-hydraulic control valve to control the hydraulic pressure in a pressure chamber of an output flow variable element so as to control the displacement of the variable element against a spring force and thereby vary the output flow within a range from a maximum output flow to a full cut-off and the pump comprises flow detecting means for generating an electric signal corresponding to the output flow of the pump, pressure detecting means for generating an electric signal corresponding to the output pressure of the pump, control means responsive to the difference between a flow setting signal and the output signal of the flow detecting means to control a driving control signal supplied to the proportional electro-hydraulic control valve and also responsive to the difference between a pressure setting signal and the output signal of the pressure detecting means to control the driving control current ,when the detected output pressure reaches a setting value, data detecting means for detecting variable data during the pump operation such as the actuator operating speed, pump speed and pump working fluid temperature, and correcting means responsive to the detection output of the data detecting means to make a correction to the driving control current in accordance with the magnitude of the variable data.

In accordance with a preferred modification of this embodiment, the correcting means has a fault detecting function so that it monitors the magnitude of said detection output from said data detecting means and generates an alarm signal when the magnitude exceeds a predetermined upper limit value.

In this case, it is so designed that for the control of the driving control current to the proportional electro-hydraulic control valve for hydraulically controlling the displacement of the pump output flow variable element, a flow feedback signal is produced from for example the displacement of the pump output flow variable element and the difference between it and a setting value is obtained thereby feedback controlling the output flow through the electro-hydraulic closed loop, that the output pressure detection value from the pressure sensor or the like is compared with a pressure setting value to effect a cut-off control through the electro-hydraulic closed loop, and that variable data during the pump operation such as the actuator operating speed, pump speed and pump working fluid temperature are detected by the data detecting means so that in response to the detection output of the data detecting means, the correcting means makes corrections corresponding to the magnitude of the variable data to the driving control current controlled by the closed loop control system, whereby close control of the closed loop containing substantially the whole hydraulic system is realized and also a predicting diagnostic function of diagnosing faults such as defects of the component devices in accordance with the detected variable data is provided.

Further, in this case, in accordance with a preferred modification of the embodiment including the safety valve positioned between the proportional electro-hydraulic control valve and the pressure chamber of the variable element so that the output pressure is directed to the variable element to place the pump in the cut-off condition when the pump output pressure reaches the setting value established by the pressure regulating spring acting against the output pressure, the safety valve is provided with a pressure adjusting mechanism for controlling the spring force of the pressure regulating spring to follow up the output pressure to remain higher than it by a predetermined pressure value.

Further, preferably the pressure adjusting mechanism is provided with a piston having a pressure receiving area which is greater than that of the valve means of the safety valve in correspondence to the predetermined pressure value whereby the pump output pressure is directed to one end face of the piston and the pressure regulating spring is deformed by the other end face of the piston in accordance with the pump output pressure.

In accordance with still another modification, a surge pressure reducing mechanism for delaying the transmission of a disturbance of the load pressure to the pressure adjusting mechanism is provided in addition to the pressure adjusting mechanism.

In accordance with another specific embodiment, the pressure adjusting mechanism includes a pilot pressure input passage for directing the output pressure to the piston, and the surge pressure reducing mechanism includes an orifice formed in the pilot pressure input passage and volume piston means connected to the pilot pressure input passage on the piston side of the orifice. In accordance with a modification of this embodiment, the surge pressure reducing mechanism includes a surge cut-off valve for detecting the differential pressure across the orifice provided in the pilot pressure input passage and causing the surge pressure in the pump outlet line to escape to the tank line.

Due to the provision of the safety valve with the pressure adjusting mechanism for controlling the spring force of its pressure regulating spring to follow up the output pressure so as to be higher than it by a given pressure value, the setting pressure of the safety valve follows up the pump operating pressure so as to be always controlled at a pressure value higher than the pump operating pressure by the given pressure value so that any surge pressure caused by a pressure disturbance on the load side is absorbed by the operation of the safety valve as soon as it reaches the safety valve setting pressure which is variably controlled in accordance with the pump operating pressure.

Also, where the surge pressure reducing mechanism for delaying the transmission of a load pressure disturbance to the pressure adjusting mechanism is included in addition to the pressure adjusting mechanism, if a surge pressure is caused on the load side, the pressure adjusting mechanism still continues its pressure adjusting operation at a pressure value corresponding to the pump output pressure before the occurrence of the surge pressure and therefore the surge pressure is absorbed until it drops to a relatively lower level. Particularly, in this case, due to the fact that the orifice of an opening which causes no delay in the operation of the piston for output pressure variations during the steady-state operation is provided in the passage of the pressure adjusting mechanism which directs the pump output pressure to the piston thus causing a differential pressure in response to the occurrence of a surge pressure and that the surge cut-off valve operable in response to the differential pressure is connected to the passage, it is possible to reduce the surge pressure on the load side to a very small value.

In accordance with the invention, the control means for supplying a control current corresponding to a setting input signal to the proportional electro-hydraulic control valve which controls a hydraulic pressure so as to control the displacement of the output flow variable element of the variable displacement piston pump with the hydraulic pressure opposing the spring force comprises, in one preferred embodiment thereof, first difference signal detecting means for generating a first signal corresponding to the difference between a predetermined pressure setting signal and the output signal of the pressure detecting means, limiter circuit means for limiting the upper limit of the magnitude of the first signal to a predetermined level, multiplier circuit means for generating an output signal corresponding to the product of a flow setting signal and the output signal of the limiter circuit means, second difference signal detecting means for generating a second signal corresponding to the difference between the output signal of the flow detecting means and the output signal of the multiplier circuit means, and amplifying means for amplifying the second signal to a desired current level and outputting it to the proportional electro-hydraulic control valve.

Further, in accordance with the invention, the control means comprises, in addition to the above-mentioned construction, correcting circuit means for making a correction to the flow setting signal to compensate for a variation in the pump volumetric efficiency by the output signal of the pressure detecting means. In this case, the multiplier circuit means generates an output signal corresponding to the product of the output signal from the correcting circuit means and the output signal from the limiter circuit means.

In accordance with another modification, the control means further comprises flow change rate detecting means for generating an output signal corresponding to the rate of change in the magnitude of the output signal from the flow detecting means. In this case, the first difference signal detecting means generates, as a first signal, a signal corresponding to the difference between the pressure setting signal and the output signal of the pressure detecting means and the output signal of the flow change rate detecting means. In a typical example, the flow change rate detecting means includes a differentiating circuit for generating a differentiated value of the output signal from the flow detecting means.

In relation with the pressure control and the flow control of the variable displacement piston pump, its actual operating conditions will be classified into the following three conditions.

A: The condition in which the load pressure is below the setting pressure and thus only the flow control is performed.

B: The condition in which the pressure control is performed in the presence of a fluid flow but the flow is not reaching the setting value as yet.

C: The condition in which there is practically no fluid flow and only the pressure control is performed.

With the control means of the variable displacement piston pump according to the invention, in the condition A the first difference signal detecting means generates a first signal having a magnitude greater than the threshold level of the limiter circuit means with the result that a pressure feedback signal having a given value limited by the limiter circuit means is applied to the multiplier circuit means and thus the setting input to the second difference signal detecting means varies in proportion to the flow setting signal alone, thereby performing the closed-loop flow feedback control by the output signal of the flow detecting means which serves as a reference input.

In the condition B, when the first signal becomes lower than the limiter threshold level, the output of the multiplier circuit means is decreased correspondingly and the magnitude of the flow setting signal is apparently changed by the pressure feedback signal. As a result of this action, the closed-loop pressure feedback is made effective to produce a fluid flow providing the setting pressure.

Where the flow change rate detecting means is additionally included, simultaneously the output of the flow change rate detecting means is also included as a negative feedback minor loop in the pressure feedback loop so that when the flow rate changes abruptly, the first signal is decreased according to the rate of change of the flow and thus a rate feedback is applied so as to prevent a pressure variation due to the abrupt flow change thereby further stabilizing the dynamic characteristics in the flow-pressure control region.

The condition C is a condition which practically requires no load flow or a blocked condition so that even if the flow setting signal to the multiplier circuit means varies, it is rendered invalid as the flow setting by the pressure feedback loop based on the first signal and the control means performs the closed-loop pressure feedback control operation by the use of the first signal or the pressure difference signal.

With the control means according to the invention, the transition between the pressure control and the flow control is effected smoothly in response to the change from the condition A to B to C and vice versa by the actions of the limiter circuit means and the multiplier circuit means and the two controls can be performed by the single proportional electro-hydraulic control valve. Where the flow change rate minor feedback loop is provided, any pressure variation due to an abrupt flow change is effectively limited in the whole control region, particularly in the flow-pressure control region thus ensuring a stable pump control with the reduced pressure pulsation.

Further, where the correcting circuit means is provided, in the flow control mode a flow correction according to the pressure detection signal may for example be utilized to compensate for a variation of the pump volumetric efficiency due to a cause such as an increase in the leakage flow due to the increased load pressure.

The above and other objects as well as advantageous features of the present invention will be better understood and will become more apparent from the following description of unlimiting embodiments of the present invention taken in conjunction with the accompanying drawings.

FIGS. *9a*, *9b* and *9c* are circuit diagrams showing specific examples of the flow change rate detecting circuit.

Figure 10:
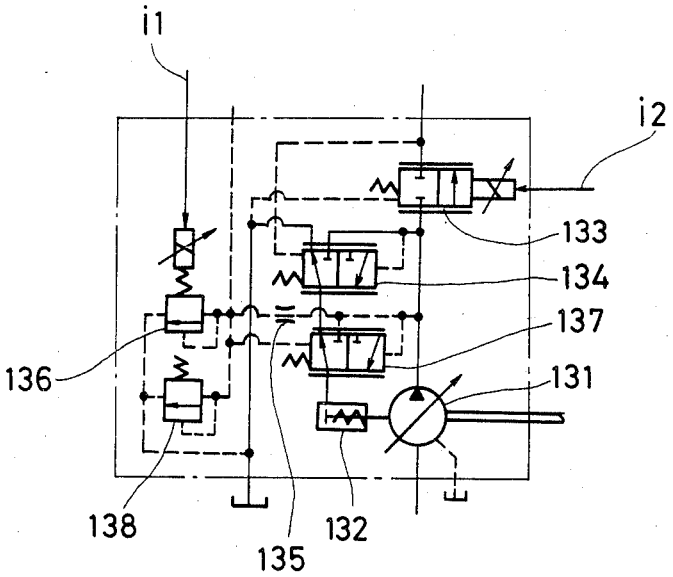
FIG.10 PRIOR ART

FIG. 10 is a hydraulic circuit diagram showing a prior art pump.

DESCRIPTION OF THE PREFERRED EMBODIMENTS

Before describing preferred embodiments of the invention, a conventional variable displacement piston pump will be described with reference to FIG. 10 with a view to facilitating understanding of the features of the invention. With this conventional variable displacement piston pump, both of its pressure and flow settings are provided in the form of electric signals as shown in FIG. 10 and the control of the displacement of a variable element 132 of a pump 131 according to a pressure setting signal i1 and a flow setting signal i2 is effected by an open loop control of a compensator valve control type employing a hydraulic pilot pressure. More specifically, in FIG. 10 a proportional electro-hydraulic flow control valve 133 is connected in tandem with the outlet side of the pump 131 and the input current i2 is applied to its proportional solenoid thereby causing its spool to perform a proportional action on the basis of the relation between the attractive force of the solenoid and the opposing spring force to determine the opening of its control orifice. The hydraulic fluid pressure in the pressure chamber of the variable element 132 is controlled by a compensator valve 134 so as to maintain the differential pressure across the orifice constant and the displacement of the variable element 132 of the pump 131 is controlled by controlling the pressure in the pressure chamber against the opposing spring force thereby obtaining a given output flow corresponding to the input current i2. On the other hand, the pilot flow from the outlet port of the pump 131 is allowed to escape from a proportional electro-hydraulic relief valve 136 through a fixed orifice 135 and the proportional electro-hydraulic relief valve 136 is proportionally controlled by the input current i1 corresponding to the setting pressure so that in response to the output pressure reaching the setting pressure the relief valve 136 is opened to flow out the pilot flow. The differential pressure across the orifice 135 is detected by a compensator valve 137 and the hydraulic fluid is introduced into the pressure chamber of the variable element 132 thereby obtaining a given pressure compensated value through the relief valve 136. Thus, this conventional pump is of the load-sensing control type. In FIG. 10, numeral 138 designates a safety valve.

With this conventional variable displacement piston pump of the load-sensing control type, due to its open-loop hydraulic control system, it is difficult to reduce the hysteresis of the solenoid as well as the hysteresis in both the pressure and flow controls due to the effects of the compressibility and viscosity of the hydraulic fluid, etc., and its controllability involve difficulties. Thus, the output pressure of the pump includes not only the load pressure but also the differential pressure across the orifice of the flow control valve 133 in the main flow passage and the flow control valve 133 must have a large build corresponding to the amount of output flow. Also, since the variable element is displaced by using as a signal the movement of the hydraulic compensator valve, there is a limitation from the dynamic characteristic point of view and also the hydraulic control system makes it difficult to provide the desired compensation. An improvement in the response tends to cause an oscillation phenomenon and thus the use of a number of such valves as the compensator valves and the pilot relief valves involving vibrating elements such as main spools and springs requires the additional provision of damping restrictors for operation stabilizing purposes and a matching adjusting operation at site in the actual use condition. Further, due to the use of the pilot pressure control, the fluid passages are much complicated and also the arrangement of the passages in the pump housing and cover are complicated. Also, the proportional electro-hydraulic control valve for receiving a pressure setting signal and the proportional electro-hydraulic control valve for receiving a flow setting signal must be provided separately with the result that the power consumption is increased and also the mounting of the valves on the pump increases the overall build of the pump thus making it difficult to make the pump more compact. Thus, the conventional pump is disadvantages in many ways.

Figure 1:
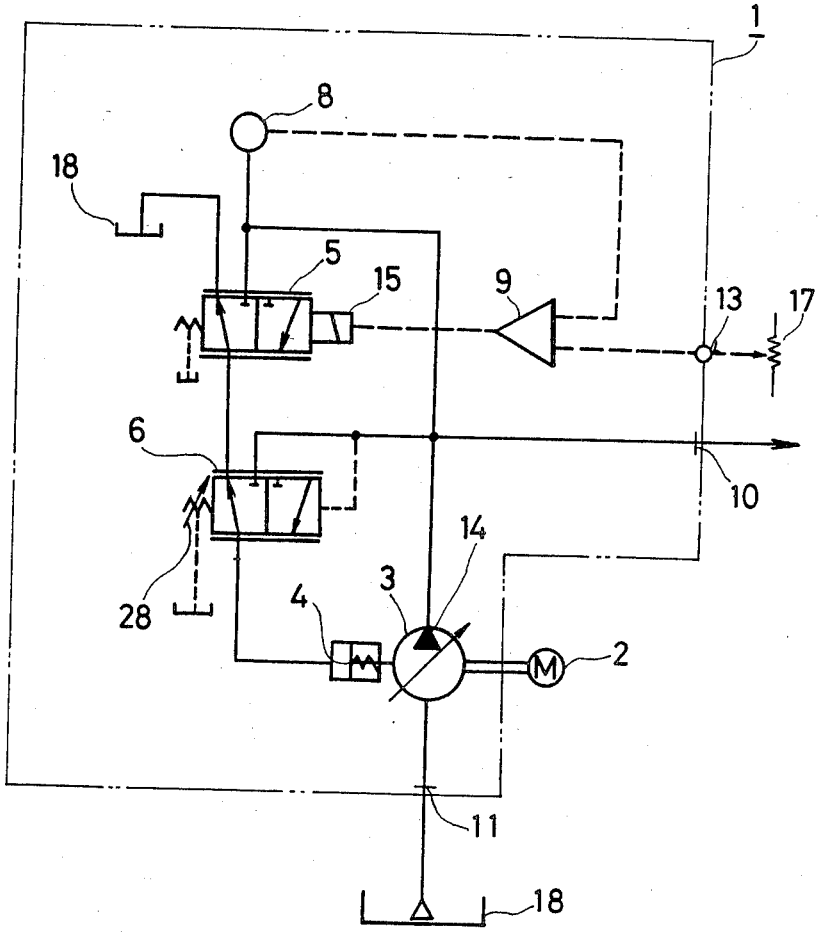
FIG. 1 is an electric and hydraulic circuit diagram showing a first embodiment of the invention.

Referring to FIG. 1, there is illustrated a first embodiment of the invention. In the Figure, generally designated at numeral 1 is a variable displacement piston pump according to the invention and it includes a pump element 3 which is driven by a motor 2 so that a hydraulic fluid is drawn in from a suction port 11 connected to a tank 18 and then delivered to a discharge port 10, and a variable element 4 which is displaced by the hydraulic pressure to control the output flow of the pump element 3. If, for example, the pump 1 is an axial piston pump, the variable element 4 includes a swash plate and a control piston for controlling the tilt angle of the swash plate. A semiconductor gage-type pressure sensor 8 is connected to an outlet port 14 of the pump element 3 through an internal fluid passage in the pump cover, for example, and the output pressure is detected in the form of an electric signal. A proportional electro-hydraulic control valve 5 and a safety valve 6 are connected in tandem in the hydraulic fluid passage between the outlet port 14 and the variable element 4 so that the pressure chamber of the variable element 4 is communicated with a tank 18 when the valves 5 and 6 are not in operation. In this case, it is possible to mount the control valve 5 on the body or cover of the pump 1, incorporate the safety valve 6 in the cover of the pump 1 and arrange the pressure sensor 8 in the control valve 5 or the body of the pump 1, for example.

The proportional electro-hydraulic control valve 5 is a three-way valve so that the pressure chamber of the variable element 4 is communicated with the tank 18 in the nonoperated condition, while in the operated condition the pressure chamber is communicated with the outlet port 14 with an opening corresponding to the input current to supply a part of the output hydraulic fluid to the pressure chamber of the variable element 4, thereby controlling the amount of displacement of the variable element 4 within a range between a maximum flow position and a full cut-off position. To supply the input current to the proportional electro-hydraulic control valve 5, a control amplifier 9 is provided by mounting it on the control valve 5, for example. The control amplifier 9 always compares the pressure setting signal applied to an input terminal 13 from an external setting adjuster 17 and the detection signal of the pressure sensor 8 and an output current corresponding to the resulting difference is supplied as an energization current to spool driving proportional solenoid plunger 15 of the control valve 5. In accordance with the input current value, the control valve 5 adjusts the opening of its control flow passage to automatically control the displacement of the variable element 4 so that in accordance with the function of the amplifier 9, a control is performed to obtain the desired pressure-flow characteristic for effecting a cut-off operation when the output pressure attains the pressure value established by the setting adjuster 17. In this case, since the amplifier 9 is included in the control loop, the gain of the amplifier 9 can be suitably adjusted so as to prevent the occurrence of vibration of the variable element 4 without taking any antivibration measure for the hydraulic system and at the same time a sharp full cut-off characteristic having a reduced pressure drooping can be ensured. In this embodiment, the output flow control can be effected by simply applying a flow setting signal to the amplifier 9 to control the opening of the communication established between the tank 18 and the pressure chamber of the variable element 4 by the proportional electro-hydraulic control valve 5 or alternatively the amount of displacement of the variable element 4 may be manually set by the adjusting screw.

With this embodiment, when the output pressure becomes excessively high due to a fault in the electric system, for example, at the instant that the output pressure reaches a pressure set by pressure regulating means 28 the safety valve 6 directly introduces the pump output pressure into the pressure chamber of the variable element 4 and the pump 1 is immediately placed in the cut-off condition.

Figure 2:
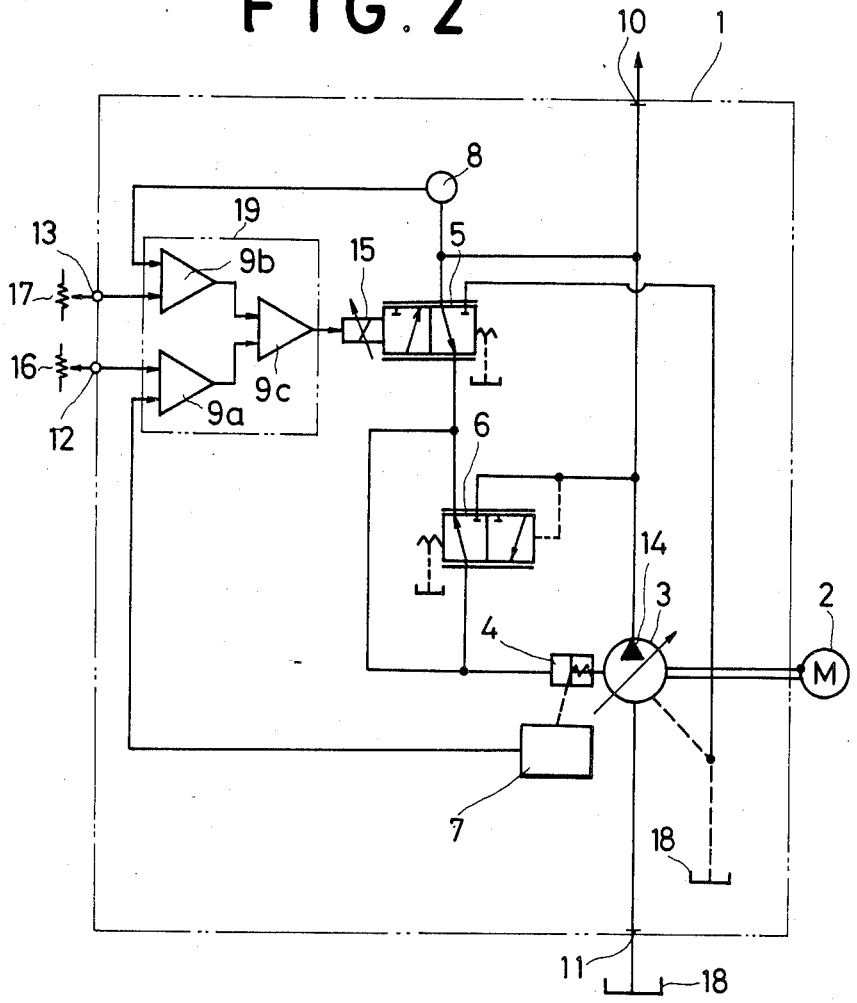
FIG. 2 is an electric and hydraulic circuit diagram showing a second embodiment of the invention.
Figure 3:
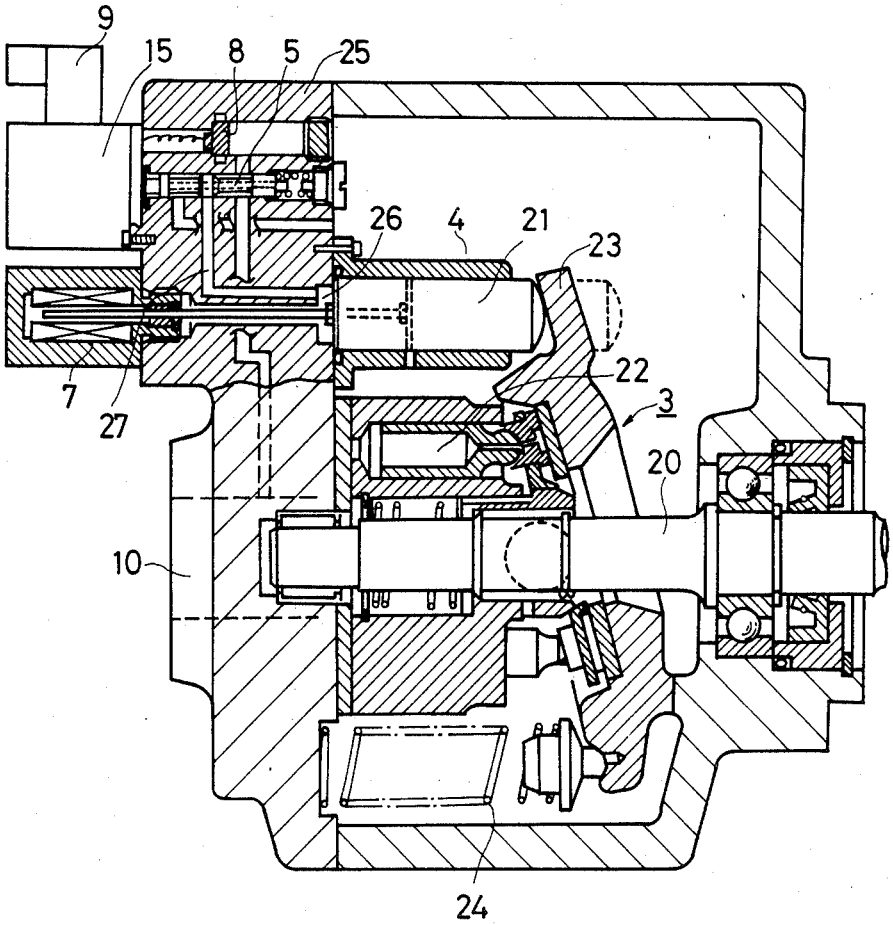
FIG. 3 is a longitudinal sectional view showing an example of the mechanical construction of the second embodiment.

FIGS. 2 and 3 show a second embodiment of the invention. In this embodiment, the pressure control as well as the output flow control are closed loop controls. In FIG. 2, generally designated at numeral 1 is a variable displacement piston pump according to this embodiment and it comprises a pump element 3 which is driven by a motor 2 through a driving shaft 20, a variable element 4 whose displacement is controlled by a hydraulic pressure opposing a spring force so as to control the output flow of the pump element 3, a proportional electro-hydraulic three-way control valve 5, safety valve 6, a displacement detector 7 for detecting the displacement of the variable element 4, a pressure sensor 8 for detecting the pump output pressure, control amplifier 19 including first and second amplifiers 9*a* and 9*b* and an output amplifier 9*c*, a discharge port 10, a suction port 11 and electric input terminals 12 and 13.

If, for example, the pump 1 is an axial piston pump, the variable element 4 includes a swash plate and a control piston for controlling the tilt angle of the swash plate and the displacement detector 7 consists of position detector such as a potentiometer or differential transformer which detects the displacement of the variable element 4 from the rotation angle of the swash plate shaft or the amount of movement of the control piston.

The pressure sensor 8 may be a semiconductor gage-type pressure sensor mounted in the pump body or the cover or in the valve body of the control valve 5 and it always detects the output pressure through the cover inner passage communicated with the outlet port 14 of the pump element 3.

The safety valve 6 and the proportional electro-hydraulic three-way control valve 5 are arranged in tandem in the hydraulic fluid passage leading from the pressure chamber of the variable element 4 to the tank 18. The safety valve 6 is so designed that the output pressure is directly introduced into the pressure chamber of the variable element 4 from the outlet port 14 when the load pressure becomes abnormally high due to the blocking of the pump outlet side or the like and reaches a circuit upper limit pressure established by its spring and in the other normal conditions the pressure chamber of the variable element 4 is connected to the proportional electro-hydraulic three-way control valve 5.

Conversely to the case of the first embodiment, the proportional electro-hydraulic three-way control valve 5 fully opens the pressure chamber of the variable element 4 to the tank 18 when the input current to the solenoid 15 is maximum and thereafter the full opening is gradually reduced as the input current is decreased so as to attain an opening proportional thereto. Then, the pressure chamber of the variable element 4 is caused to start opening gradually to the pump discharge port side so that when the input current is reduced to zero, a part of the output hydraulic fluid is introduced directly into the pressure chamber of the variable element 4 through the safety valve 6. In this way, the displacement of the variable element 4 is controlled over the range from the maximum output flow position to the full cut-off position while ensuring the fail-safe function upon the interruption of the input current. In order to supply the input current to the proportional electro-hydraulic three-way control valve 5, the control amplifier 19 is provided by for example mounting it on the three-way control valve 5. The first amplifier 9*a* of the amplifier 19 receives the detection signal from the displacement detector 7 and the setting flow signal from an external output flow setting adjuster 16 and the first amplifier 9*a* applies a signal corresponding to the difference between the two inputs to the output amplifier 9*c* which in turn applies the corresponding current to the solenoid 15. On the other hand, the second amplifier 9*b* receives the detection signal from the pressure sensor 8 and the setting pressure signal from an external pressure setting adjuster 17 so that when the two inputs are equal, the second amplifier 9*b* applies a cut-off signal to the output amplifier 9*c*. The output amplifier 9*c* applies a current output corresponding to the output signal of the first amplifier 9*a* to the solenoid 15 until the cut-off signal is applied to it. When the cut-off signal is applied, the output amplifier 9*c* applies a current output to the solenoid 15 so as to attain a control valve opening such that a part of the output pressure is introduced into the pressure chamber of the variable element 4 and the pump 1 is placed in the cut-off condition thereby moving the variable element 4 into the full cut-off position where its displacement is substantially zero. In other words, the two control circuits are combined in such a manner that either a flow control current (i2) or a pressure control current (i1) is selected as an input current to the solenoid 15 of the proportional electro-hydraulic three-way control valve 5 depending on the presence or absence of a difference between the setting pressure and the detected pressure by the pressure sensor 8. During the starting period of the pump 1, the respective valves are in the positions shown in FIG. 2 so that the variable element 4 is moved into its maximum flow position by the force of the counter spring until an output pressure is produced. After the pump 1 has been started, a current corresponding to the flow setting signal from the flow setting adjuster 16 is applied to the solenoid 15 from the amplifier 19 so that the control passage of the three-way control valve 5 is opened to the tank 18 with a given opening and the hydraulic fluid in the pressure chamber of the variable element 4 is discharged to the tank line. As a result, the variable element 4 is moved to its setting flow position by the spring counter pressing the variable element 4 and its displacement is detected from moment to moment to fed back to the first amplifier 9*a* by the displacement detector 7. Thus, when the variable element 4 reaches the setting flow position, the difference output from the first amplifier 9*a* is reduced to zero and the opening of the control passage of the control valve 5 is closed. As a result, the pump 1 delivers the fluid at the setting flow while controlling the variable element 4 at the desired position. In this way, the given output flow is established and the output hydraulic fluid is supplied to the actuator from the discharge port 10 thereby operating the actuator. In this case, if the actuator is stopped at the stroke end, for example, the output pressure is increased gradually. At this time, the output of the pressure sensor 8 is fed back to the second amplifier 9*b* so that when the output pressure reaches the value of the pressure setting signal, a cut-off signal is generated from the second amplifier 9*b* and a given current value is applied to the solenoid 15 from the output amplifier 9*c*. Thus, the control passage of the three-way control valve 5 is opened to the outlet port 14 side to move the variable element 4 to its zero displacement position so that the pump output pressure is introduced into the pressure chamber of the variable element 4 and the pump 1 is placed in the cut-off condition where the displacement of the variable element 4 is zero, that is, the pump 1 reduces the output flow to substantially zero.

When the input current is no longer applied, the proportional electro-hydraulic three-way valve 5 is automatically restored by the spring force and thus the pressure chamber of the variable element 4 is communicated with the outlet port 14 with the full opening. Therefore, when the input to the solenoid 15 is interrupted by any fault in the electric system, the pump 1 is immediately placed in the cut-off condition and in this way one of the fail-safe functions for the electric system is incorporated.

On the other hand, the safety valve 6 is connected to communicate the pressure chamber of the variable element 4 to the outlet port 14 in the portion nearer thereto than the three-way control valve 5 so that when the output pressure reaches the circuit upper limit value, the pump 1 is cut off in preference to the control valve 5.

FIG. 3 shows an exemplary construction of the axial piston pump. In the Figure, the component parts corresponding to those of FIG. 2 are designated by the same reference numerals. In FIG. 3, the tilt angle of a swash plate 23 for determining the stroke of a piston 22 of the pump element 3 is varied by a hydraulic pressure against a spring 24 by means of a control piston 21 forming the variable element 4 and the linear displacement detector 7 of the differential transformer type is incorporated in a pump cover 25 at the back of the control piston 21. The three-way control valve 5 and the pressure sensor 8 are also incorporated in the cover 25 and the passages leading to the discharge port 10 and the drain side in the pump housing and a hydraulic fluid passage 27 leading to the three-way control valve 5 from a pressure chamber 26 at the back of the control piston 21 are also arranged inside the cover 25 thereby making the pump 1 compact and concentrating the minute works in the cover 25. Note that the safety valve 6 is not shown in FIG. 3.

Figure 4:
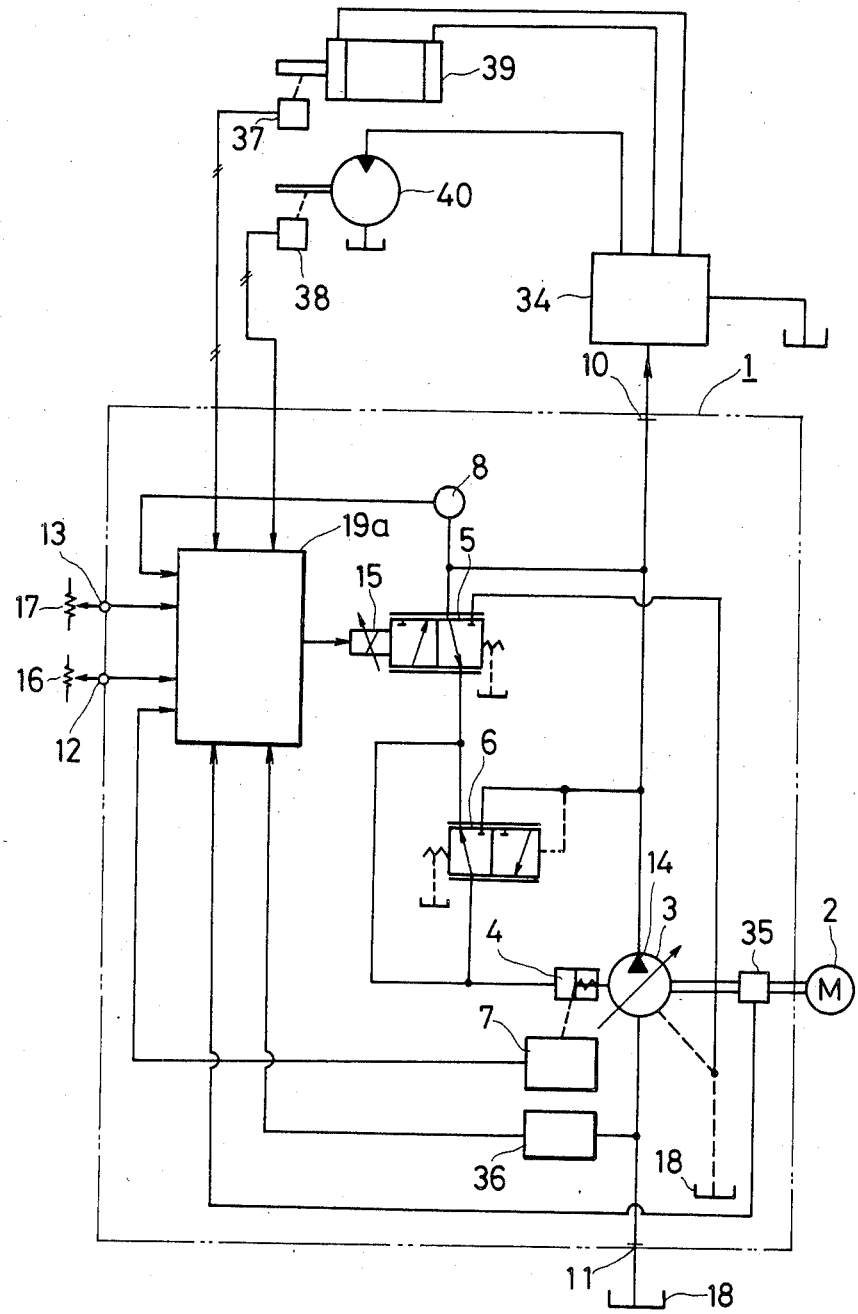
FIG. 4 is an electric and hydraulic circuit diagram showing a third embodiment of the invention.

FIG. 4 shows a third embodiment of the invention. In FIG. 4, the same component parts as shown in FIG. 2 are designated by the same reference numerals and will not be described in any detail.

Control amplifier 19*a* is substantially the same with the counterpart of FIG. 2 and it includes a pressure setting signal input terminal 13 and a flow setting signal input terminal 12. The amplifier 19*a* also has a function of correcting the driving control current in accordance with the variable data detection values that will be described in the following.

Actuator control valve 34 including for example a directional control valve connected to the pump outlet line is typically represented by a box in FIG. 4. In the Figure, the actuators whose speed and torque are controlled by the pump output fluid through the control valve 34 are shown in the form of a cylinder 39 and a hydraulic motor Numeral 35 designates a speed detector for detecting the speed of an electric motor 2, 36 a temperature detector for detecting the fluid temperature in a pump 1, 37 a speed detector for detecting the speed of a cylinder 39, and 38 a speed detector for detecting the speed of the hydraulic motor 40. During the operation of the pump 1, the detectors detect various variable data dynamically and apply them as correction data to the control amplifier means 19*a*.

The control amplifier 19*a* applies a correction corresponding for example to a predetermined pump volumetric efficiency change to the driving control current to solenoid 15 of a proportional electro-hydraulic control valve 5 in accordance with the magnitude of each variable data. The control amplifier 19*a* is also designed so that the magnitudes of the applied variable data are compared with separately predetermined reference levels and are monitored so as to give an alarm individually or in combination with respect to those exceeding the upper limit levels. In this way, any irregularity of the component devices in the system can be detected before the occurrence of a fault.

While, in the embodiment of FIG. 4, the various electric compensating circuits are provided in the closed loop including the electric system and the mechanical system, the compensating circuits give harm conversely so that there is the danger of delaying the follow-up of the variable element of the pump when responding to a pressure disturbance on the load side and this gives rise to difficulties in some cases.

In other words, while usually the safety valve is provided between the proportional electro-hydraulic control valve and the variable element pressure chamber such that the output pressure is introduced into the variable element of the pump when the electric signal disappears or the load pressure rises abnormally, if, for example, the maximum operating pressure of the pump is 140 $Kg{\cdot}f/cm^2$, the setting of the safety valve is $(140+\alpha)$ $Kg{\cdot}f/cm^2$ and this setting value is fixed independently of the pump operating pressure. As a result, if there is a delay in the follow-up of the pump variable element when responding to a pressure disturbance on the load side as mentioned previously, a high surge pressure due to the disturbance is caused until it reaches the pressure level at which the safety valve comes into operation and this tends to cause any unexpected trouble in the devices.

Figure 5:
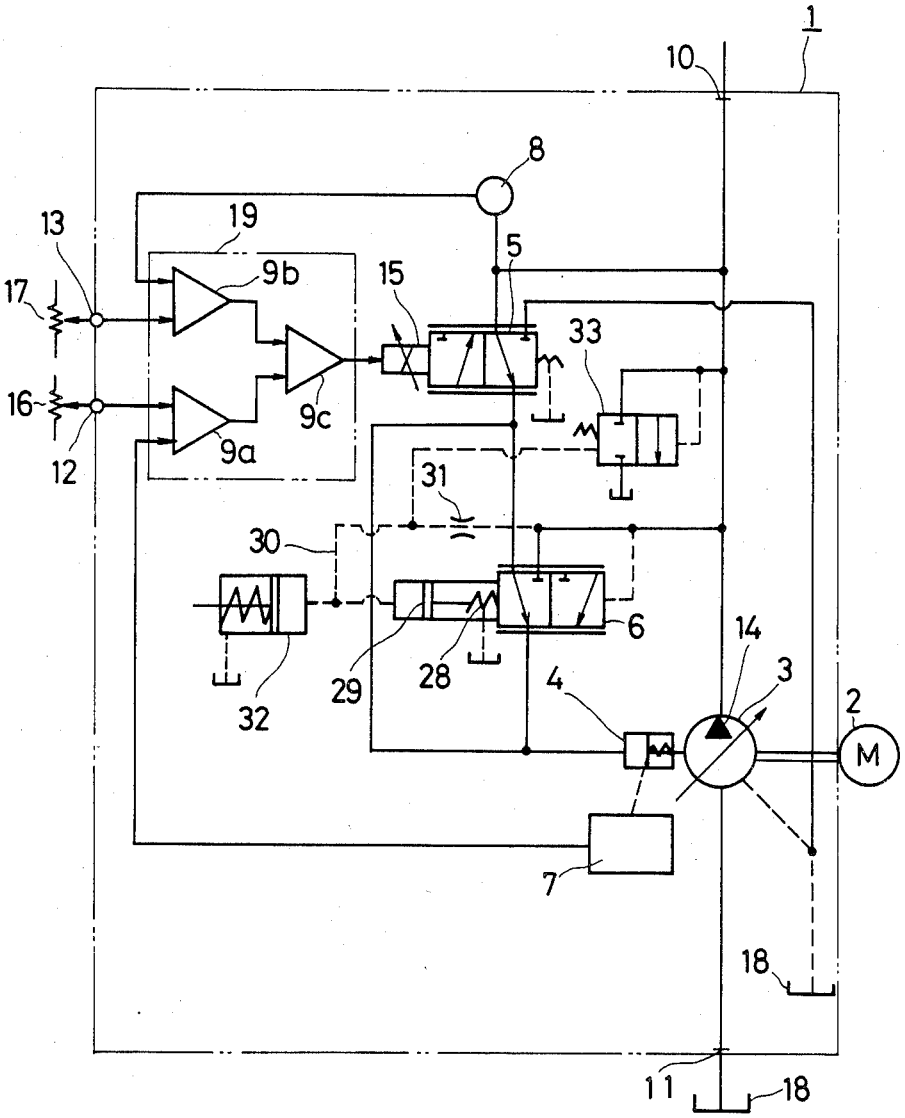
FIG. 5 is an electric and hydraulic circuit diagram showing a fourth embodiment of the invention.
Figure 6:
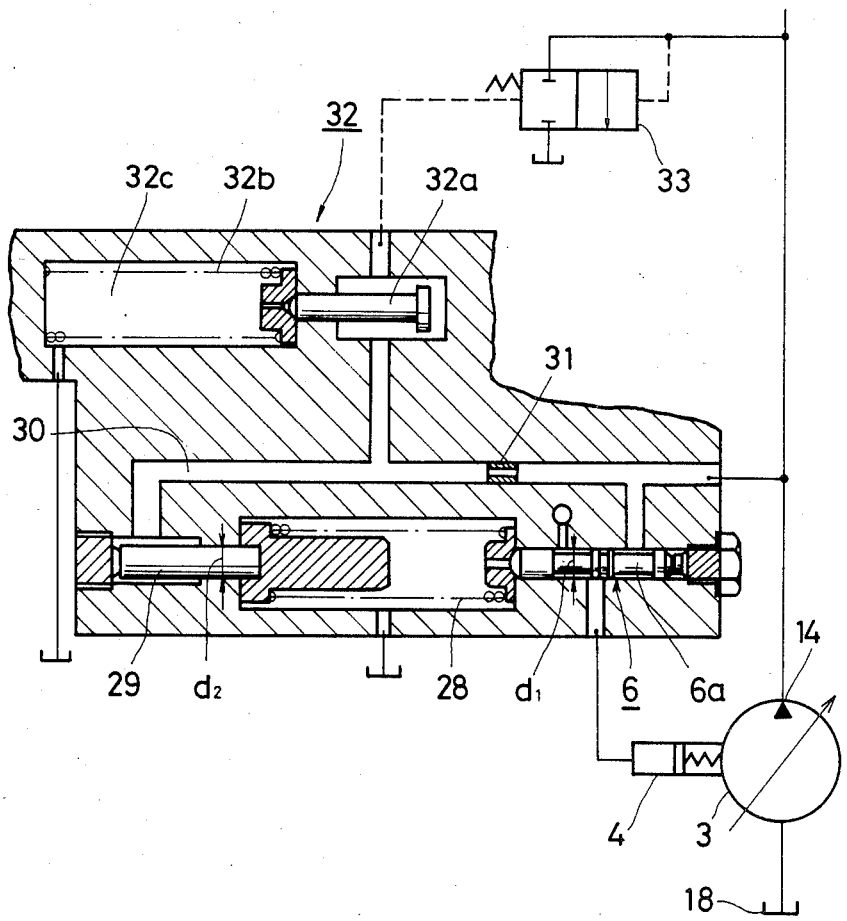
FIG. 6 is a schematic sectional view showing an exemplary mechanical construction of the principal part of the fourth embodiment.

FIGS. 5 and 6 show a fourth embodiment of the invention which is designed so that a surge pressure caused on the load side of a pump is immediately caused to escape to a tank line to reduce it irrespective of delay elements in an electric control system and independently of the operating pressure of the pump or alternatively a surge cut-off valve of the differential pressure type is provided in the case of a system which extremely dislikes a surge pressure.

In FIG. 5, various compensating elements and actuators are not shown for purposes of simplifying the illustration. Also, in FIG. 5 the same component parts as the counterparts of FIGS. 2 and 3 are designated by the same reference numerals. The embodiment of FIG. 5 includes, in addition to the construction of FIGS. 2 and 3, a load pressure responsive piston 29 for controlling the amount of deformation of a pressure regulating spring 28 for setting an operating pressure of the safety valve 6, a restrictor 31 formed in a pilot pressure input passage 30 for causing a pump output pressure or load pressure to act on the piston 29, volume piston 32 connected to the passage 30 on the piston side of the fixed orifice 31, and a surge cut-off valve 33 for causing a part of the pump output fluid to escape to the tank line when the differential pressure across the orifice 31 exceeds a value predetermined by the spring.

As will be seen from FIG. 6 showing the construction of the portions associated with it, the safety valve 6 is constructed so that the pressure regulating spring 28 supports a valve spool 6*a* of the safety valve 6 at its one end against the output pressure and it also displaceably supports the load pressure responsive piston 29 at the other end. In this case, the piston 29 has a diameter $d_2$ which is greater than the diameter $d_1$ of the valve spool 6a to obtain a given pressure receiving area difference and the pump outlet-side hydraulic fluid is caused to act on the piston 29 through the pilot pressure input passage 30. The fixed orifice 31 is arranged midway in the pilot pressure input passage 30 and the volume piston 32 is connected to the passage 30 on the piston 29 side of the orifice 31. Since the valve spool 6a and the piston 29 are designed so that $d_2 > d_1$, the pressure regulating spring 28 is set higher than the output pressure by an amount corresponding to the ratio of $d_2^2/d_1^2$.

The safety valve spool 6a and the pressure regulating spring 28 are arranged in tandem and the volume piston 32 is supported by a spring 32b mounted in a volume chamber 32c connected to the tank line thus absorbing any abrupt pressure change to the piston 29. In this case, the opening of the orifice 31 is selected so that the piston 29 satisfactorily follows up or responds to any steady-state output pressure change without delay.

When the pump 1 is operated so that the actuator (not shown) connected to the discharge port 10 is brought into operation, the operating pressure is directed to the load pressure responsive piston 29 through the orifice 31 so that the piston 29 is urged by the then current output pressure and the pressure regulating spring 28 is deformed in accordance with the load. As a result, the safety valve 6 is adjusted in accordance with the load to a pressure slightly higher than it as mentioned previously. In this condition, if, for example, the actuator is struck against the stroke end thus causing a pressure disturbance on the load side, in accordance with the relation between the orifice 31 and the volume piston 32a and the spring 32b the pressure on this side of the orifice 31 (on the discharge port side) tends to rise momentarily, whereas on the piston 29 side of the orifice 31 the pressure rises gradually in accordance with the first order lag characteristic curve. Thus, a differential pressure is produced across the orifice 31 and the safety valve 6 stays operating in the condition corresponding to the load pressure before its response to the pressure disturbance thus correspondingly reducing the surge pressure caused by the disturbance.

At this time, if the surge cut-off valve 33 is connected as shown in the Figure, the surge cut-off valve 33 is operated instantaneously by the differential pressure caused across the orifice 31 by the disturbance and the surge pressure is reduced further.

Figure 7:
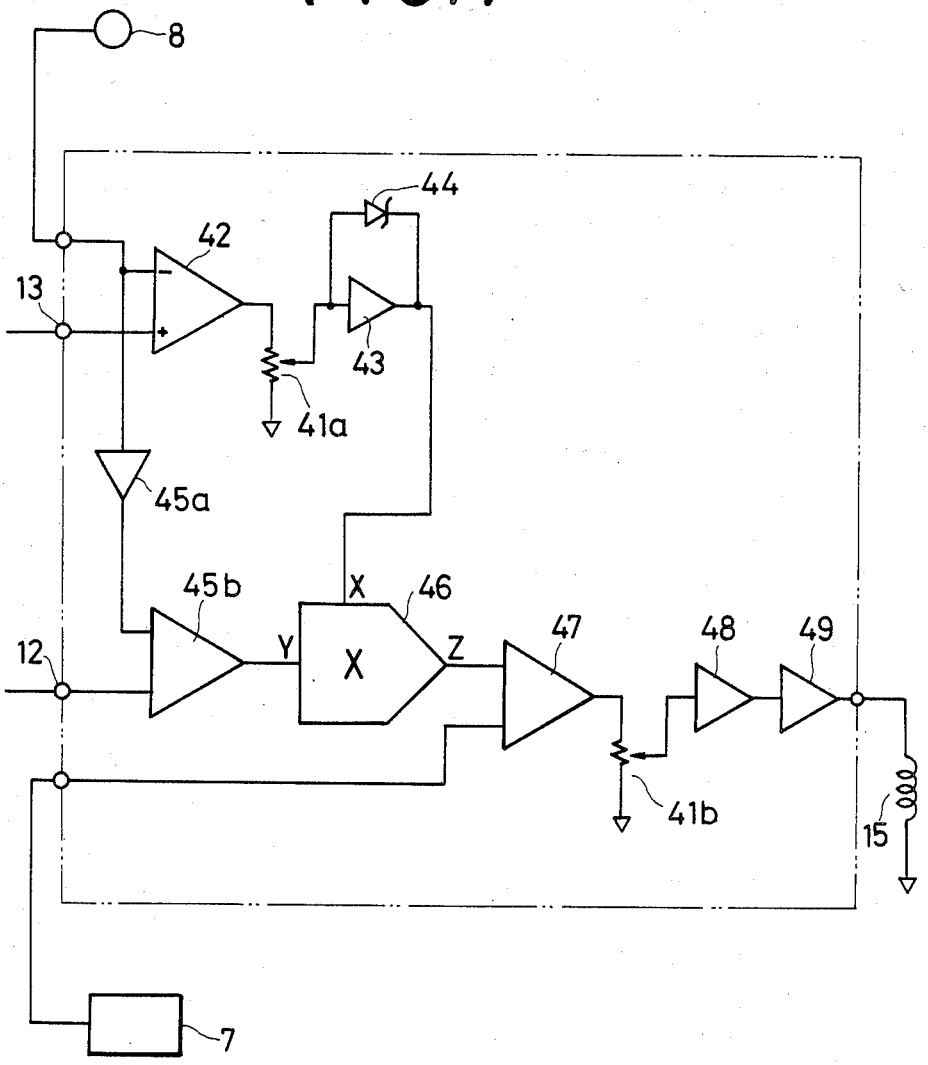
FIG. 7 is a principal circuit diagram showing an exemplary circuit construction of the control amplifier.

The control amplifier 19 is for example constructed as shown in FIG. 7 by way of example and the respective setting signals are applied to the pressure setting signal input terminal 13 and the flow setting signal input terminal 12, respectively. An adder/subtractor 42 generates a pressure difference signal (first signal) X corresponding to the difference between the pressure setting signal and the detection output of the pressure sensor 8. The pressure signal X is applied to an amplifier 43 with a limiter 44 through a gain controller 41a so that the signal X is applied as such to a multiplier 46 if it is lower than the threshold level of the limiter 44, whereas if the signal X is higher than the threshold level, it is applied to the multiplier 46 as a signal of a fixed value limited to the threshold value by the limiter 44. The flow setting signal Y from the terminal 12 is also applied to the multiplier 46 and in this embodiment a correction is made to the flow setting signal Y by the pressure setting signal X through a pump volume efficiency correcting circuit including an amplifier 45a and a differential amplifier 45b. The multiplier 46 generates an output corresponding to the product Z ($=X \cdot Y$) of the signals X and Y (where $0 \leqq X \leqq$ and $\leqq Y \leqq 1$). Another adder/subtractor 47 generates an output signal corresponding to the difference between the output signal Z of the multiplier 46 and the detection output of the displacement detector 7. This output signal is then amplified by a difference signal amplifier 48 and a current amplifier 49 through a gain controller 41b and supplied to the solenoid coil 15 of the proportional electro-hydraulic control valve 5.

Assuming now that the flow setting signal and the pressure setting signal are applied so that a setting flow is supplied but the load pressure is lower than the setting pressure, the adder/subtractor 42 generates a large pressure difference signal X. This pressure difference signal X is amplified by the amplifier 43 so that the signal X is limited to the predetermined value by the limiter 44 since it is greater than the predetermined upper limit level. The signal X of the predetermined value is applied to the multiplier 46 where it is multiplied with the flow setting signal Y. Since the signal X has the fixed value, the output Z of the multiplier 46 is varied by the signal Y alone thus generating a flow command signal which is proportional to the flow setting signal Y. The difference between the flow command signal Z and the detection output of the displacement detector 7 is detected by the adder/subtractor 47 and it is then supplied to the solenoid coil 15 through the amplifier 48 and 49 thereby performing the closed-loop flow feed-back control.

When the load pressure is increased during the flow control, the difference signal X between the pressure setting signal and the pressure detection signal, from the adder/subtractor 42, is correspondingly decreased in magnitude. When the load pressure approaches the setting pressure value very closely, the magnitude of the output signal from the difference signal amplifier 43 deviates from the threshold level of the limiter 44 and starts decreasing toward zero. The output Z of the multiplier 46 which has been determined by the flow setting signal Y now starts decreasing in accordance with the decrease in the signal X and this action results in a flow providing the setting pressure. The reason is that the pressure feedback control is available and the pressure control is effected so far as the difference signal amplifier 43 operates at voltages lower than the limiter voltage.

When the load pressure rises so that the load flow is not practically required, that is, in the blocked condition, even if the flow setting signal Y to the multiplier 46 is varied, it is made invalid as the flow setting by the pressure feedback loop based on the signal Y so that at this time the multiplier 46 operates proportionally in accordance with the pressure difference signal alone considering the flow setting input Y is constant. This control condition is the pressure feedback control.

These operations are the same in the case of the reverse change, that is, in the case of the transition from the pressure control mode to the flow control mode.

Figure 8:
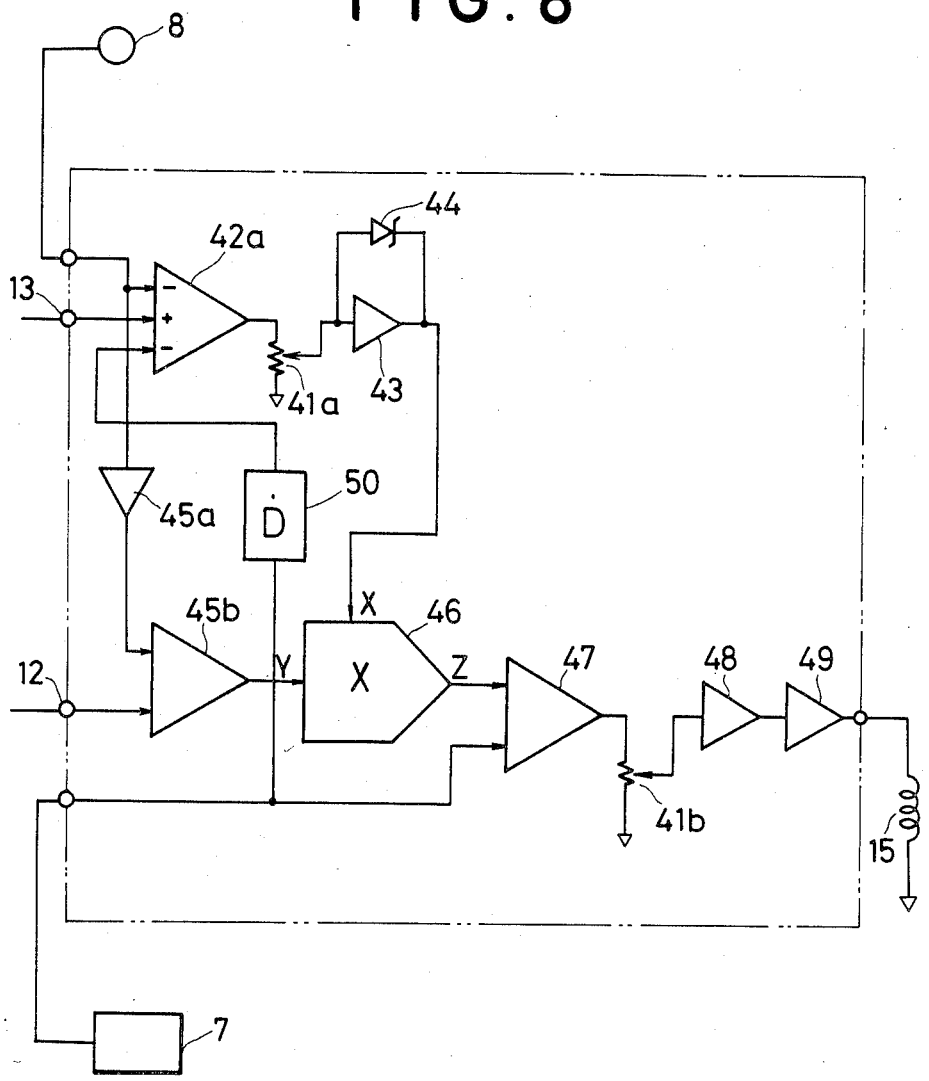
FIG. 8 is a principal circuit diagram showing another exemplary circuit construction of the control amplifier.

FIG. 8 shows a modification of the control amplifier 19 and the same reference numerals as in the circuit construction of FIG. 7 designate the equivalent component parts.

In FIG. 8, numeral 50 designates a flow change rate detecting circuit comprising a differentiating circuit for receiving the output signal of the displacement detector 7 to generate a differentiated signal D. An adder/subtractor 42*a* receives the pressure setting signal from the input terminal 13 at its positive input terminal and it also receives the detection output of the pressure sensor 8 and the differentiated output of the flow change rate detecting circuit 50 at its respective negative input terminals thereby generating a pressure difference signal (first signal) X corresponding to the difference between the input signals. This pressure difference signal X is amplified by the amplifier 43 so that if the signal X is higher than a predetermined upper limit level, it is limited to a constant value by the limiter 44. This constant value signal X is applied to the multiplier 46 where it is multiplied with the other input signal or the flow setting signal Y. If the signal X is constant, the output Z of the multiplier 46 is varied by the signal Y alone and consequently a flow command signal proportional to the flow setting signal Y is generated. The difference between the flow command signal Z and the detection output of the displacement detector 7 is detected by the adder/-subtractor 47 and then supplied to the solenoid means 15 through the amplifiers 48 and 49, thereby performing the closed-loop flow feedback control. In this case, if the variable element 4 of the pump 1 is displaced rapidly so that the fluid flow tends to change, the flow change rate detecting circuit 50 generates a differentiated signal and the effect of its rate feedback is small so far as the output of the pressure sensor 8 is small.

When the load pressure is increased during the flow control, this correspondingly decreases the magnitude of the difference signal X between the pressure setting signal and the pressure detection signal generated from the adder/subtractor 42. When the load pressure becomes very close to the setting pressure value, the magnitude of the output signal from the difference signal amplifier 43 deviates from the threshold level of the limiter 44 and starts decreasing toward zero. The output Z of the multiplier 46 which has been determined by the flow setting signal Y is now caused to decrease by the decrease of the signal X in correspondence thereto and this action results in a fluid flow providing the setting pressure. This is due to the fact that when the difference signal amplifier 43 operates at voltages lower than the limiter voltage, the pressure feedback control is valid and the pressure control is effected. In this condition, if the variable element 4 is displaced rapidly so that the output flow tends to change, the flow change rate detecting circuit 50 generates a differentiated output and the magnitude of the difference signal between the pressure setting signal and the pressure detection signal in the adder/subtractor 42 is subjected to a dynamic variable control so as to prevent a pressure variation due to the flow change.

When the load pressure is increased so that the load flow is not practically required, the pressure feedback control is effected as a matter of course as in the case of FIG. 7.

Figure 9A:
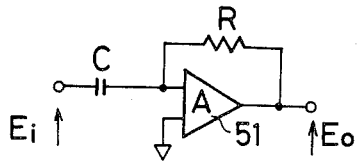
Figure 9B:
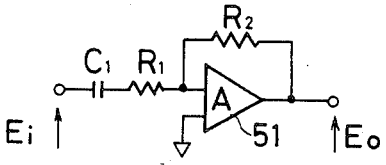
Figure 9C:
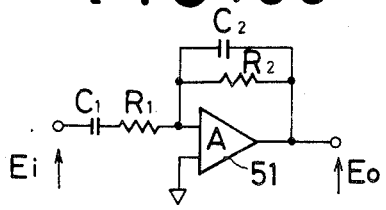

While, in the modification, the flow change rate detecting circuit 50 comprises a differentiating circuit, specifically it may be any one of various forms including a differentiating circuit comprising, as shown in FIG. 9*a*, a combination of an amplifier 51, a resistor R and a capacitor C whereby a differentiated output voltage Eo is produced with respect to an input voltage Ei with a transfer function of $-T\cdot S = -C\cdot R\cdot dEi/dt$, a pseudo differentiating circuit comprising for example a combination of an amplifier 51, resistors $R_1$ and $R_2$ and a capacitor C as shown in FIG. 9*b* whereby a pseudo differentiated output voltage Eo is electrically produced with respect to an input voltage Ei with a transfer function of $-T_2\cdot S/(1+T_1\cdot S)$ or a pseudo differentiating circuit comprising, as shown in FIG. 9*c*, a combination of an amplifier 51, resistors $R_1$ and $R_2$ and capacitors $C_1$ and $C_2$ whereby a pseudo differentiated output voltage Eo is produced with respect to an input voltage Ei with a transfer function of $-T_3\cdot S/(1+T_1\cdot S)(1+T_2\cdot S)$.

We claim:

1. A variable displacement piston pump of a type which varies an output flow by controlling a hydraulic pressure to displace a variable element against a spring force, said pump comprising:

pressure detecting means for generating an electric signal output corresponding to a pump output pressure;

a proportional electro-hydraulic control valve means for communicating a pressure chamber of the variable element with a tank or a pump outlet port with an opening proportional to an input current; and control amplifier means for receiving an externally applied pressure setting signal and the electric output signal from said pressure detecting means to control the input signal to said proportional elector-hydraulic control valve means in such a manner that said output pressure is introduced into the pressure chamber of said variable element to cut off said pump when a pressure detected by said pressure detecting means attains a setting pressure value, said variable element being connected to flow detecting means for detecting a pump output flow in accordance with the displacement of said variable element, and said control amplifier means including a control circuit responsive to a difference between an externally applied flow setting signal and a flow detection signal from said flow detecting means to adjust the magnitude of said input current.

2. A pump according to claim 1, wherein said proportional electro-hydraulic control valve means has an automatic restoring function whereby said pump output pressure is supplied to said variable element to cut off said pump when said input current is not present.

3. A pump according to claim 1, further comprising data detecting means for detecting variable data during pump operation, said variable data including at least one of data consisting of actuator operating speed, pump rotation speed and pump working fluid temperature, and correcting means responsive to detection outputs of said data detecting means to make a correction corresponding to the magnitude of said variable data to the driving input current of said control valve.

4. A pump according to claim 3, wherein said correcting means has a fault detecting function for monitoring the magnitude of a detection output thereof to generate an alarm signal when said detection output exceeds predetermined upper limit value.

5. A pump according to claim 1 wherein said control amplifier means comprises first difference signal detecting means for generating a first signal corresponding to a difference between said pressure setting signal and the output signal of said pressure detecting means, limiter circuit means for limiting an upper limit of an amplitude of said first signal to a predetermined level, multiplier circuit means for generating an output signal corresponding to a product of said flow setting signal and an output signal of said limiter circuit means, second difference signal detecting means for generating a second signal corresponding to a difference between the output signal of said flow detecting means and the output signal of said multiplier circuit means, and amplifier means for amplifying said second signal to a desired current level and outputting the same to said proportional electro-hydraulic control valve.

6. A pump according to claim 5 further comprising correcting circuit means responsive to the output signal of said pressure detecting means to make a correction to said flow setting signal to compensate for a pump volumetric efficiency change.

7. A pump according to claim 5, further comprising flow change rate detecting means for generating an output signal corresponding to a rate of change of the output signal from said flow detecting means, and wherein said first difference signal detecting means generates a first signal corresponding to a difference between said pressure setting signal and the output signal of said pressure detecting means and the output signal of said flow change rate detecting means.

8. A pump according to claim 7, wherein said flow change rate detecting means includes a differentiating circuit.

9. A variable displacement piston pump of a type which varies an output flow by controlling a hydraulic pressure to displace a variable element against a spring force, said pump comprising:

pressure detecting means for generating an electric signal output corresponding to a pump output pressure;

a proportional electro-hydraulic control valve means for communicating a pressure chamber of the variable element with a tank or a pump outlet port with an opening proportional to an input current;

control amplifier means for receiving an externally applied pressure setting signal and the electric output signal from said pressure detecting means to control the input signal to said proportional electro-hydraulic control valve means in such a manner that said pump output pressure is introduced into the pressure chamber of said variable element to cut off said pump when a pressure detected by said pressure detecting means attains a setting pressure value;

a safety valve for supplying said output pressure to said variable element to cut of said pump when said pump output pressure reaches an upper limit value predetermined by a pressure regulating spring; and said safety valve including pressure adjusting means responsive to said pump output pressure regulating spring at a value higher than said output pressure by a predetermined pressure value.

10. A pump according to claim 9, wherein said pressure adjusting means includes a piston having a pressure receiving area greater than that of valve means of said safety valve in correspondence to said predetermined pressure value whereby said pump output pressure is applied to one end of said piston to deform said pressure regulating spring by the other end of said piston in accordance with said pump output pressure.

11. A pump according to claim 9, further comprising surge pressure reducing means for delaying the transmission of a disturbance of a load pressure to said pressure adjusting means.

12. A pump according to claim 11, wherein said pressure adjusting means includes a piston having a pressure receiving area greater than that of valve means of said safety valve in correspondence to said predetermined pressure value, and a pilot pressure input passage for supplying said pump output pressure to said piston, and wherein said surge pressure reducing means includes an orifice provided in said pilot pressure input passage, and volume piston means connected to said pilot pressure input passage on the piston side of said orifice.

13. A pump according to claim 12, wherein said surge pressure reducing means include a surge cut-off valve for detecting a differential pressure across said orifice provided in said pilot pressure input passage to release a surge pressure in a pump outlet line to a tank line.

14. A variable displacement piston pump of a type which varies an output flow by controlling a hydraulic pressure to displace a variable element against a spring force, said pump comprising:

pressure detecting means for generating an electric signal output corresponding to a pump output pressure;

a proportional electro-hydraulic control valve means for communicating a pressure chamber of the variable element with a tank or a pump outlet port with an opening proportional to an input current; and control amplifier means for receiving an externally applied pressure setting signal and the electric output signal from said pressure detecting means to control the input signal to said proportional electro-hydraulic control valve means in such a manner that said pump output pressure is introduced into the pressure chamber of said variable element to cut off said pump when a pressure detected by said pressure detecting means attains a setting pressure value, said control valve means including supply means for supplying the output pressure to the variable element to cut off said pump in the absence of said input current.

15. A pump according to claim 14, wherein said proportional electro-hydraulic control valve means has an automatic restoring function whereby said pump output pressure is supplied to said variable element to cut off said pump when said input current is not present.

16. A pump according to claim 14, wherein said variable element is connected to flow detecting means for detecting a pump output flow in accordance with the displacement of said variable element, and wherein said control amplifier means includes a control circuit responsive to a difference between an externally applied flow setting signal and a flow detection signal from said flow detecting means to adjust the magnitude of said input current.

17. A pump according to claim 16, wherein said control amplifier means comprises first difference signal detecting means for generating a first signal corresponding to a difference between said pressure setting signal and the output signal of said pressure detecting means, limited circuit means for limiting an upper limit of an amplitude of said first signal to a predetermined level, multiplier circuit means for generating an output signal corresponding to a product of said flow setting signal and an output signal of said limiter circuit means, second difference signal detecting means for generating a second signal corresponding to a difference between the output signal of said flow detecting means and the output signal of said multiplier circuit means, and amplifier means for amplifying said second signal to a desired current level and outputting the same to said proportional electro-hydraulic control valve.

18. A pump according to claim 17, further comprising correcting circuit means responsive to the output signal of said pressure detecting means to make a correction to said flow setting signal to compensate for a pump volumetric efficiency change.

19. A pump according to claim 17, further comprising flow change rate detecting means for generating an output signal corresponding to a rate of change of the output signal from said flow detecting means, and wherein said first difference signal detecting means generates a first signal corresponding to a difference between said pressure setting signal and the output signal of said pressure detecting means and the output signal of said flow change rate detecting means.

20. A pump according to claim 19, wherein said flow change rate detecting means includes a differentiating circuit.

21. A pump according to claim 14, further comprising a safety valve whereby when said pump output pressure reaches an upper limit value predetermined by a pressure regulating spring, said pump output pressure is supplied to said variable element to cut off said pump.

22. A pump according to claim 21, wherein said safety valve includes pressure adjusting means responsive to said pump output pressure to follow-up control the spring force of said pressure regulating spring at a value higher than said pump output pressure by a predetermined pressure value.

23. A pump according to claim 22, wherein said pressure adjusting means includes a piston having a pressure receiving area greater than that of valve means of said safety valve in correspondence to said predetermined pressure value whereby said pump output pressure is applied to one end of said piston to deform said pressure regulating spring by the other end of said piston in accordance with said pump output pressure.

24. A pump according to claim 22, further comprising surge pressure reducing means for delaying the transmission of a disturbance of a load pressure to said pressure adjusting means.

25. A pump according to claim 24, wherein said pressure adjusting means includes a piston having a pressure receiving area greater than that of valve means of said safety valve in correspondence to said predetermined pressure value, and a pilot pressure input passage for supplying said pump output pressure to said piston, and wherein said surge pressure reducing means includes an orifice provided in said pilot pressure input passage, and volume piston means connected to said pilot pressure input passage on the piston side of said orifice.

26. A pump according to claim 25, wherein said surge pressure reducing means include a surge cut-off valve for detecting a differential pressure across said orifice provided in said pilot pressure input passage to release a surge pressure in a pump outlet line to a tank line.

* * * * *